US008678091B2

(12) United States Patent
Nelson et al.

(10) Patent No.: US 8,678,091 B2
(45) Date of Patent: Mar. 25, 2014

(54) MAGNETIC RETRIEVAL APPARATUS AND METHOD FOR RETAINING MAGNETS ON A DOWNHOLE MAGNETIC RETRIEVAL APPARATUS

(75) Inventors: Jonathan F. Nelson, Houston, TX (US); Gregory L. Hern, Porter, TX (US)

(73) Assignee: Baker Hughes Incorporated, Houston, TX (US)

( * ) Notice: Subject to any disclaimer, the term of this patent is extended or adjusted under 35 U.S.C. 154(b) by 506 days.

(21) Appl. No.: 12/794,354

(22) Filed: Jun. 4, 2010

(65) Prior Publication Data

US 2011/0285155 A1 Nov. 24, 2011

Related U.S. Application Data

(63) Continuation-in-part of application No. 12/782,207, filed on May 18, 2010, now abandoned.

(51) Int. Cl.
*E21B 21/00* (2006.01)

(52) U.S. Cl.
USPC ..... 166/311; 175/325.4

(58) Field of Classification Search
USPC ..... 166/311, 66.5, 99, 173, 241.3, 170, 166/175, 301; 175/325.2, 325.1, 325.4; 184/6.25
See application file for complete search history.

(56) References Cited

U.S. PATENT DOCUMENTS

| | | | | |
|---|---|---|---|---|
| 3,637,033 | A * | 1/1972 | Mayall | 175/320 |
| 4,026,805 | A * | 5/1977 | Fowler | 210/223 |
| 6,439,303 | B1 | 8/2002 | Sorhus et al. | 166/99 |
| 6,655,462 | B1 | 12/2003 | Carmichael et al. | 166/311 |
| 6,833,069 | B1 * | 12/2004 | Asterlin | 210/222 |
| 7,137,449 | B2 | 11/2006 | Silguero | 166/301 |
| 7,219,724 | B2 | 5/2007 | Theriot, Sr. | 166/66.5 |
| 7,513,299 | B2 | 4/2009 | Ruttley | 166/66.5 |
| 2007/0138103 | A1 * | 6/2007 | Klatt | 210/695 |

FOREIGN PATENT DOCUMENTS

| | | | |
|---|---|---|---|
| WO | WO2009-002185 | 12/2008 | E21B 31/06 |
| WO | WO2009-009456 | 1/2009 | E21B 17/10 |
| WO | WO 2010007434 A2 * | 1/2010 | E21B 31/06 |

* cited by examiner

*Primary Examiner* — Kenneth L Thompson
*Assistant Examiner* — Ronald Runyan
(74) *Attorney, Agent, or Firm* — Shawn Hunter

(57) ABSTRACT

Magnetic retrieval tools for use in a wellbore or other tubular member to remove metallic debris. A magnetic retrieval tool includes a tool body having a central shaft with a plurality of ribs that project radially outwardly therefrom. The ribs present lateral sides that have recesses formed therein. Magnet bars are retained within the recesses by wedge members and retaining rings. The magnet bars include a hollow protective housing that encloses a plurality of magnets. Retaining plugs are used to secure the magnets within the housing.

16 Claims, 7 Drawing Sheets

MAGNETIC RETRIEVAL APPARATUS AND METHOD FOR RETAINING MAGNETS ON A DOWNHOLE MAGNETIC RETRIEVAL APPARATUS

This application is a continuation-in-part of U.S. patent application Ser. No. 12/782,207, which was filed on May 18, 2010 now abandoned.

BACKGROUND OF THE INVENTION

1. Field of the Invention

The present invention generally relates to the design of magnetic retrieval devices used for cleaning the interior of tubular members.

2. Description of the Related Art

Metallic debris accumulates within wellbores and other tubular members during production of subterranean fluids, such as hydrocarbon fluids. This metallic debris typically includes tiny metal shavings and cuttings. These shavings and cuttings result from numerous frictional operations that might occur within the wellbore or tubular, including the cutting of sidetracking windows, milling, drilling through stuck devices and objects, as well as general operations that cause metal-to-metal scraping to occur.

Devices used for the removal of metallic debris by magnets are described, for example, in U.S. Pat. No. 7,515,299, U.S. Pat. No. 7,219,724 and U.S. Pat. No. 7,137,449.

SUMMARY OF THE INVENTION

The invention provides magnetic retrieval tools for use in a wellbore or other tubular members to remove metallic debris. An exemplary magnetic retrieval tool is described which includes a tool body having a central shaft with a plurality of ribs that project radially outwardly therefrom. The ribs present lateral sides that have recesses formed therein. Magnet bars are retained within the recesses by wedge members and retaining rings.

In a described embodiment, the magnet bars include a hollow protective housing that encloses a plurality of magnets. Retaining plugs are used to secure the magnets within the housing.

BRIEF DESCRIPTION OF THE DRAWINGS

The advantages and other aspects of the invention will be readily appreciated by those of skill in the art and better understood with further reference to the accompanying drawings in which like reference characters designate like or similar elements throughout the several figures of the drawings and wherein.

DETAILED DESCRIPTION OF THE PREFERRED EMBODIMENTS

Figure 1:
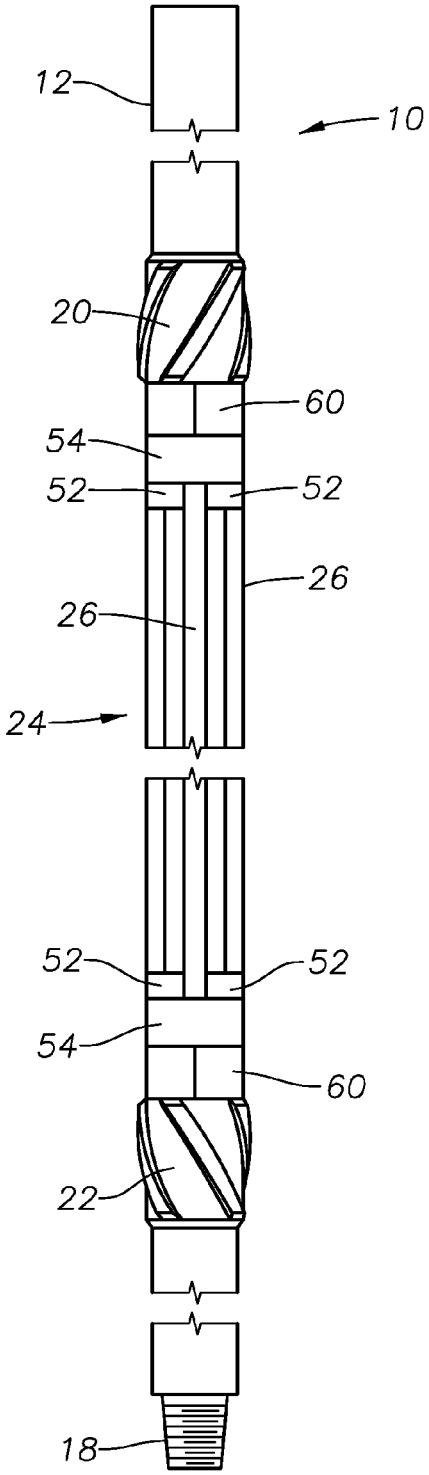
FIG. 1 is an external side view of an exemplary magnetic retrieval tool constructed in accordance with the present invention.
Figure 2:
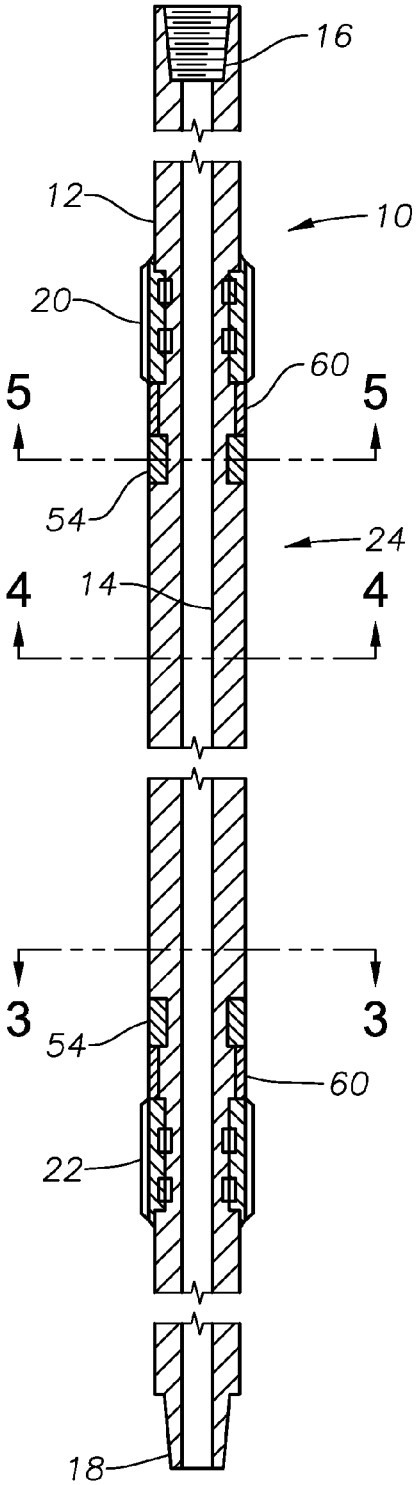
FIG. 2 is a side, cross-sectional view of the magnetic retrieval tool shown in FIG. 1.

FIGS. 1-6 illustrate an exemplary magnetic retrieval tool 10 for use in removing metallic debris from a wellbore or other surrounding tubular. The tool 10 includes a generally cylindrical tool body 12 that defines a central axial flowbore 14. The exemplary tool 10 has an upper axial end with a box-type threaded portion 16 and a lower axial end with a pin-type threaded portion 18 for incorporating the tool 10 into a tool string, as is known in the art.

Figure 3:
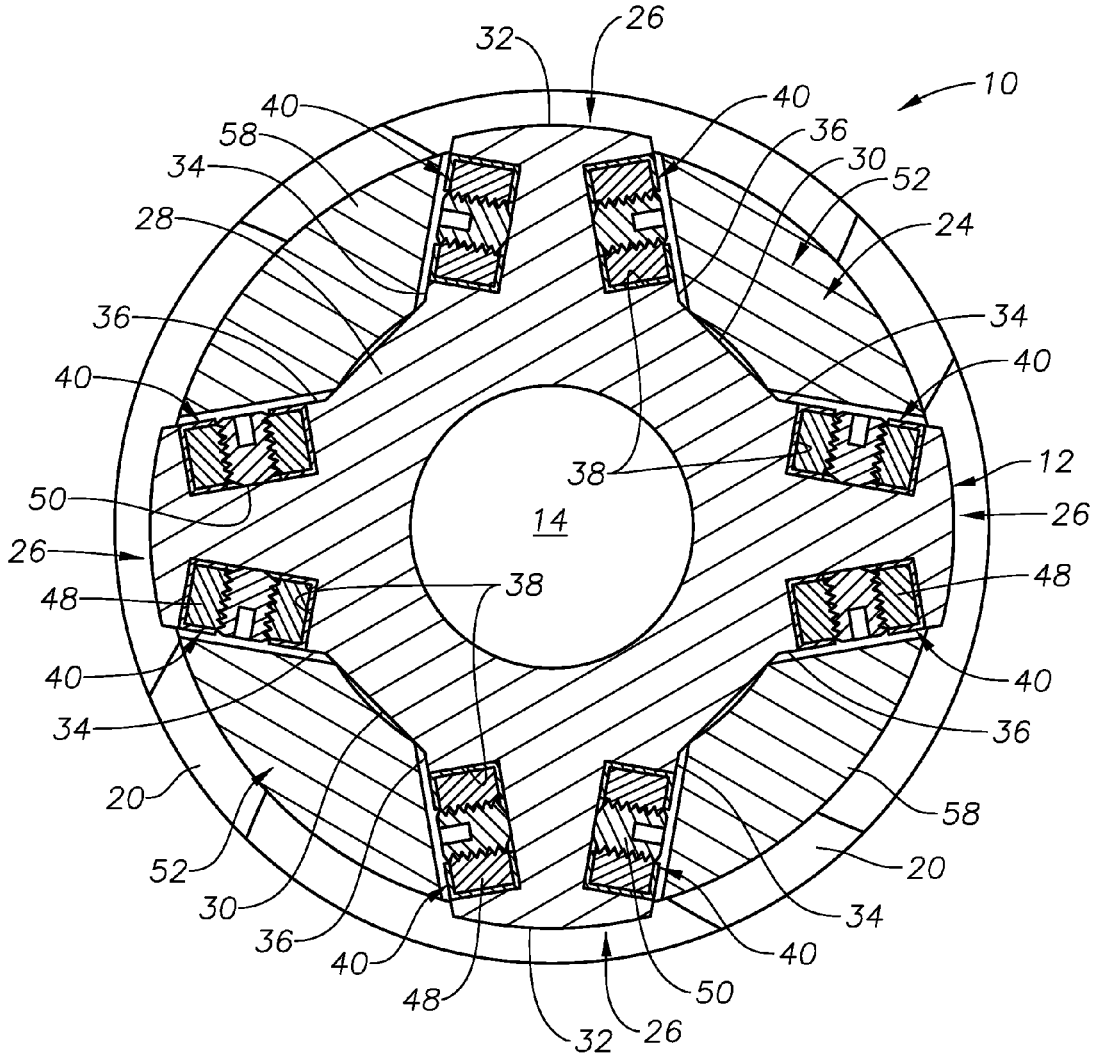
FIG. 3 is an axial cross-section taken along line 3-3 in FIG. 2.
Figure 4:
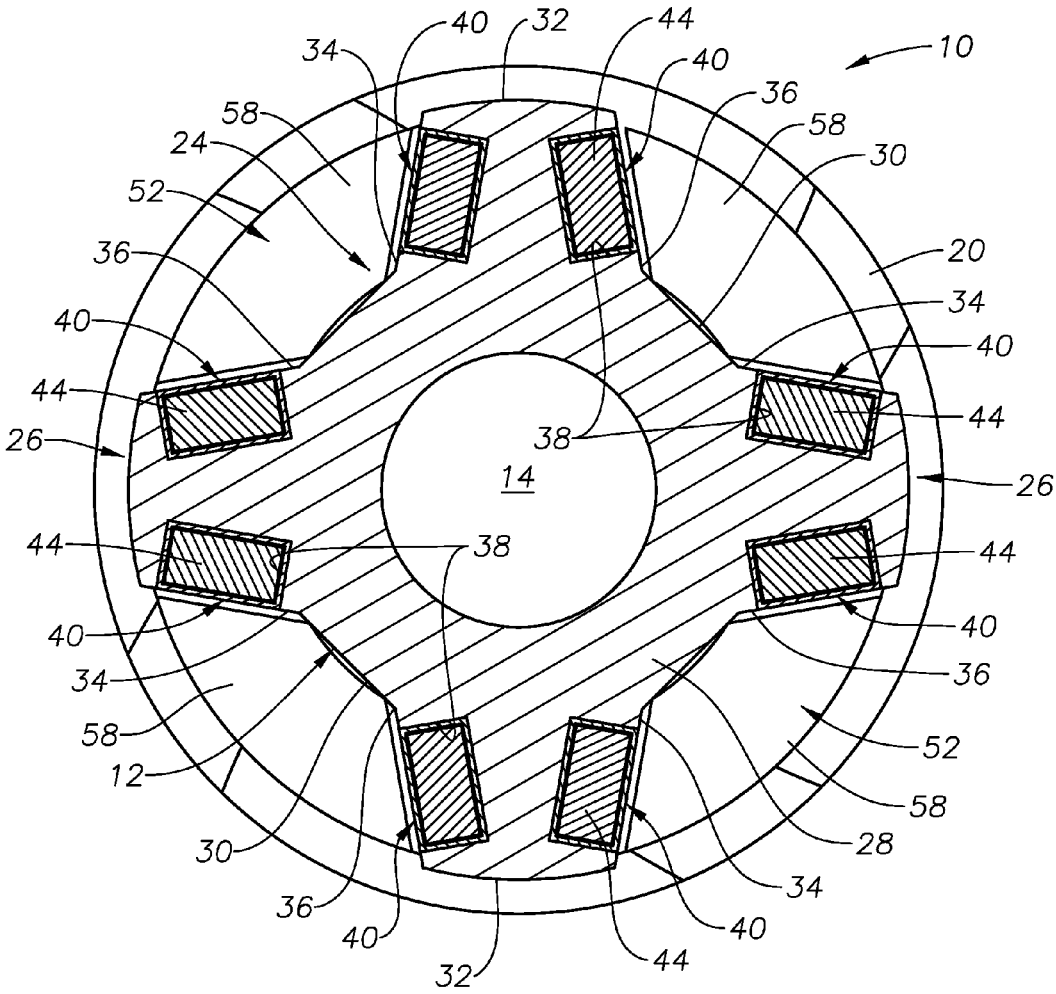
FIG. 4 is an axial cross-section taken along line 4-4 in FIG. 2.
Figure 5:
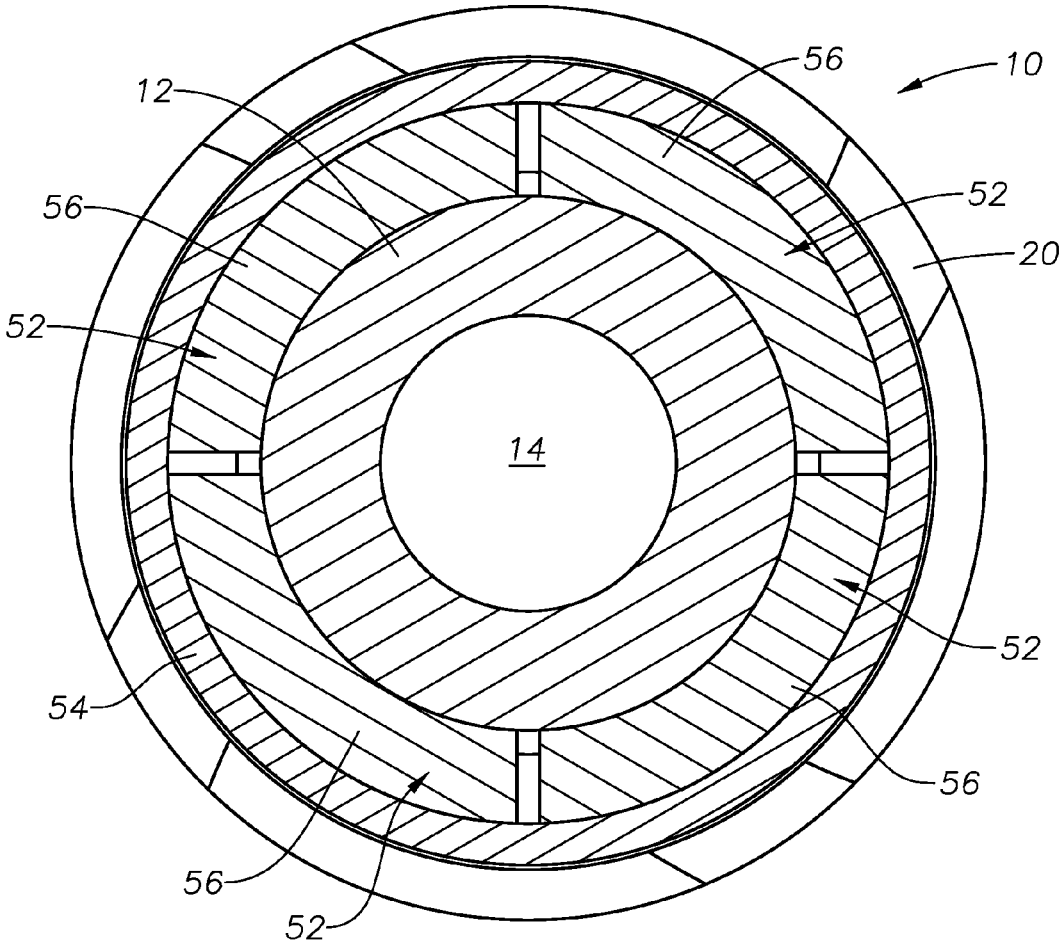
FIG. 5 is an axial cross-section taken along line 5-5 in FIG. 2.

The tool body 12 carries upper and lower stabilizers 20, 22. The stabilizers 20, 22 are each rotatable with respect to the tool body 12 and may be identical in construction. A magnetic retrieval portion, generally shown at 24, is located axially between the upper and lower stabilizers 20, 22. As best seen in FIGS. 3 and 4, the magnetic retrieval portion 24 includes a plurality of axially extending ribs 26 that project radially outwardly from an inner shaft 28. The shaft 28 presents radially reduced recesses 30 that are located angularly between each pair of ribs 26. In a currently preferred embodiment, there are four ribs 26 and four recesses 30. Preferably also, the ribs 26 are equally radially spaced apart from one another about the circumference of the shaft 28.

Referring once again to FIGS. 3 and 4, it can be seen that the ribs 26 each present an outer radial surface 32 and opposite lateral sides 34 and 36. A longitudinal cavity 38 is formed within each lateral side 34, 36 of each rib 26. A magnetic member is disposed within each cavity 38. In a currently preferred embodiment, the magnetic member takes the form of a magnet tube 40.

Figure 7:
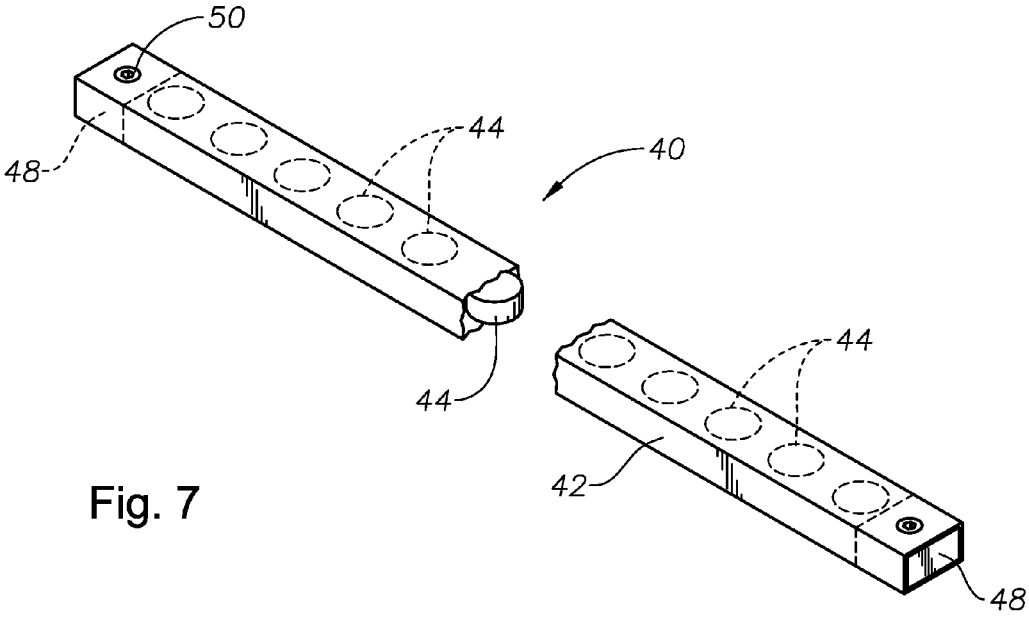
FIG. 7 is an isometric view of an exemplary magnet tube used with the magnetic retrieval tool of FIGS. 1-6 and shown apart from other components of the tool.
Figure 8:
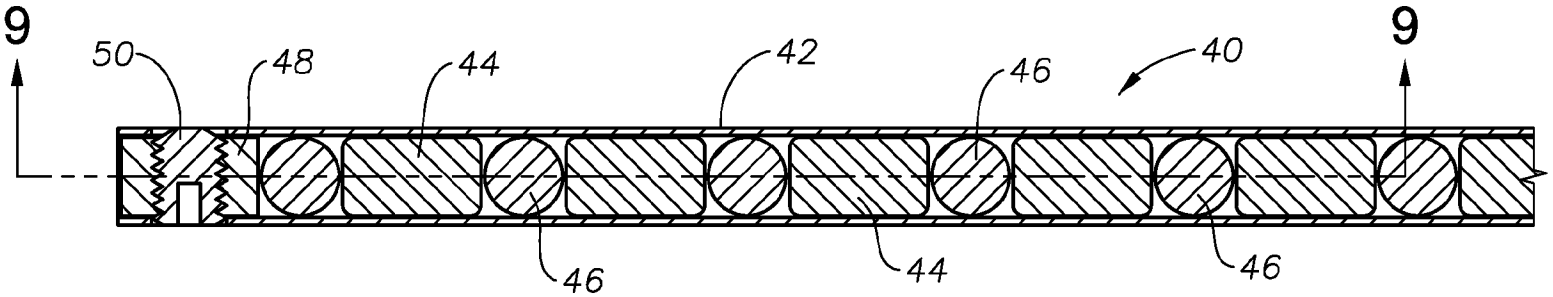
FIG. 8 is a cross-sectional view of a portion of the magnet tube shown in FIG. 7.
Figure 9:
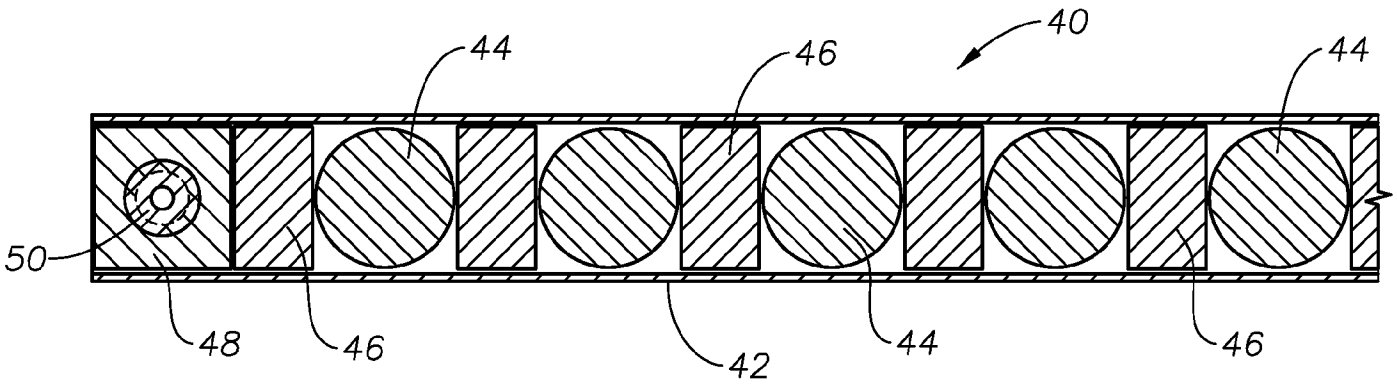
FIG. 9 is a cross-sectional view taken along line 9-9 in FIG. 8.

An exemplary magnet tube 40 is depicted in FIGS. 7-9. Each magnet tube 40 includes an outer hollow protective housing 42 that is preferably formed of a non-magnetic material, such as aluminum. In the depicted embodiment, the housing 42 has a rectangular cross-section. However, other shapes may be used. The housing 42 is shaped and sized to reside within a recess 38 in a complimentary manner. A plurality of magnets 44 and spacers 46 are disposed within the housing 42. Magnet tube 40 will have the strongest magnetic field for collecting magnetic debris if the North magnetic poles for all of the magnets 44 that are inserted into housing 42 face the same direction. When the magnetic poles face the same direction, the sides of the magnets 44 repel each other. If housing 42 is filled with magnets 44 that have the magnetic poles facing the same direction, the amount of repelling force will be significant and it might be difficult to install the retaining block 48 and set screws 50. The purpose of the spacers 46 is to limit the repelling force between magnets 44 so that the magnets 44 can be installed or removed from the housing 42 safely. A spacer 46 is disposed between each two magnets 44. Spacers 46 are preferably formed of non-magnetic material, such as plastic, but could be made of any other suitable material. The magnets 44 are depicted as having a cylindrical shape. However, they may have other shapes. Retaining blocks 48 are located within the axial ends of the housing 42 and are secured therein by set screws 50. The retaining blocks 48 serve to retain the magnets 44 and spacers 46 within the housing 42.

Figure 6:
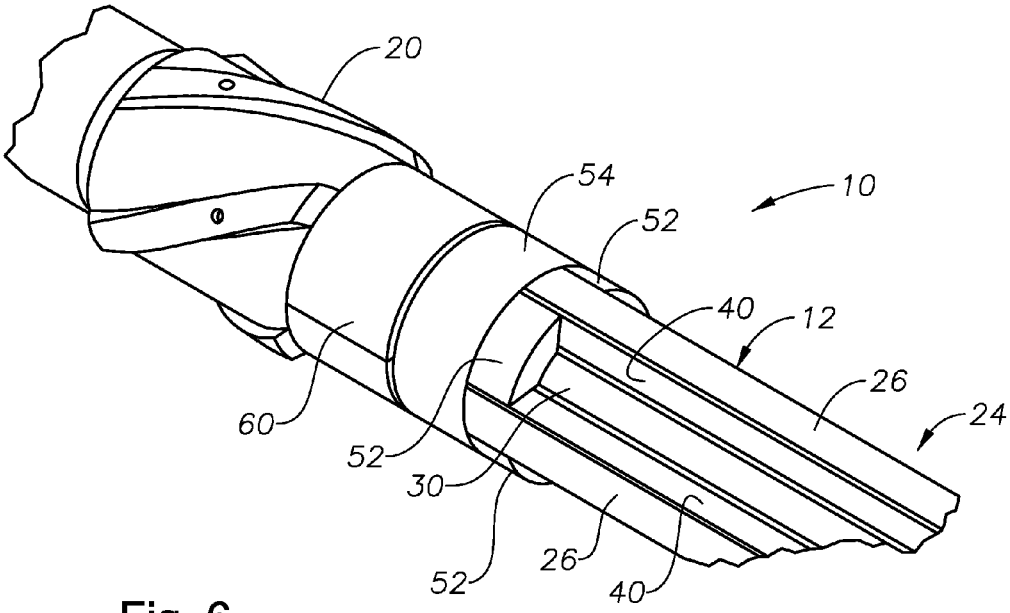
FIG. 6 is an isometric view of a portion of the magnetic retrieval tool shown in FIGS. 1-5.
Figure 10:
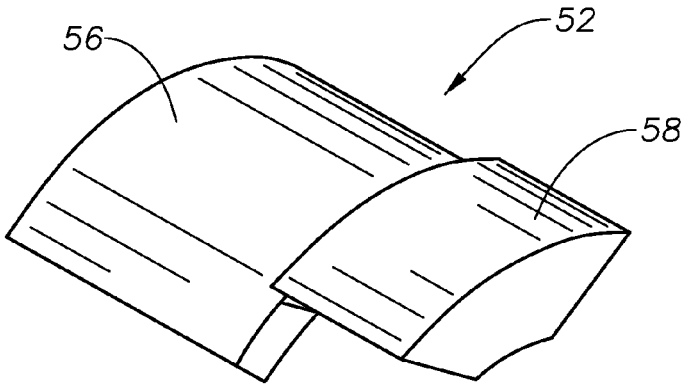
FIGS. 10 and 11 are isometric views of an exemplary wedge retaining block used in the magnetic retrieval tool of FIGS. 1-6 and shown apart from other components of the tool.
Figure 11:
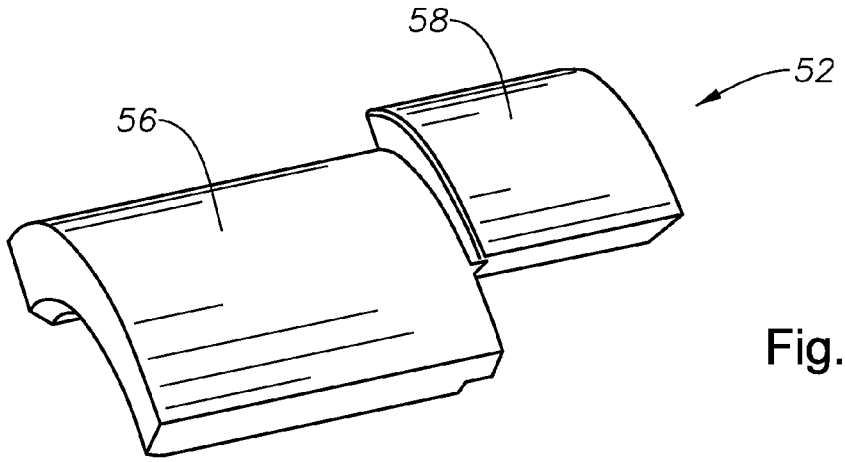
Figure 12:
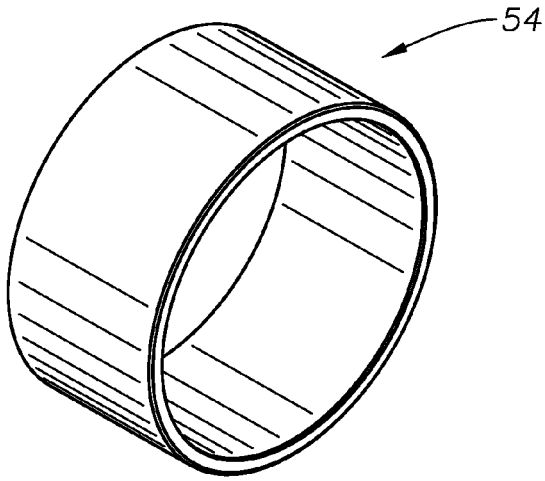
FIG. 12 is an isometric view of an exemplary retaining sleeve used in the magnetic retrieval tool of FIGS. 1-6 and shown apart from other components of the tool.

A magnet tube 40 is retained within each cavity 38. Shaped wedge members 52 and a retaining ring 54 are used to secure the magnet tubes 40 therein. In the depicted embodiment, there are four wedge members 52. Exemplary wedge members 52 are depicted in FIGS. 10 and 11. The wedge members 52 each have a body with two portions 56 and 58. A first portion 56 approximates the axial length of the retaining ring 54 and is radially curved in the manner of an arc segment. The second portion 58 is radially offset from the first portion 56. The second portion 58 has a larger radius of curvature than the first portion 56. When the tool 10 is assembled, the retaining ring 54 surrounds the first portions 56 of the wedge members 52. The second portions 58 of the wedge members 52 are shaped and sized to fit into the recesses 30 of the magnetic retrieval portion 24 and will retain the magnet tubes 40 inside of the cavities 38. FIGS. 3, 4 and 6 illustrate the manner in which the second portions 58 of the wedge members 52 retain the magnet tubes 40 within the cavities 38. A split bearing sleeve 60 axially retains retaining ring 54. Stabilizers 20 or 22 are threaded onto the split bearing sleeve 60. The stabilizers 20, 22 prevent axial movement of the retaining rings 54 upon the tool body 12. When assembled in this manner, the magnet tubes 40 will attract metallic debris as the tool 10 is rotated and moved axially within a surrounding tubular. Metallic debris will be attracted to the magnet bars 40 and may collect within the recesses 30 on the tool body 12.

In operation, the tool 10 is incorporated into a tool string, as is known in the art. The tool string is inserted into a surrounding tubular, such as wellbore casing or liner. The tool string is then moved within the surrounding tubular and debris is collected by the tool 10.

Those of skill in the art will recognize that numerous modifications and changes may be made to the exemplary designs and embodiments described herein and that the invention is limited only by the claims that follow and any equivalents thereof.

What is claimed is:

1. A magnetic retrieval tool comprising:
a tool body having a central shaft;
a plurality of ribs extending outwardly from the shaft and extending axially along the shaft, each of the ribs presenting at least one outer lateral side surface with at least one cavity formed therein;
a radially-reduced recess disposed angularly between each two adjoining ribs;
a magnetic member disposed within each cavity, the magnetic member comprising a housing and a magnet residing within the housing;
the magnetic member being retained within the cavity by a wedge member that resides within the recess; and
a retaining ring that surrounds the tool body and secures the wedge member within the recess.

2. The tool of claim 1 wherein a plurality of magnets reside within the housing.

3. The tool of claim 2 wherein a spacer is disposed between adjacent magnets within the housing.

4. The tool of claim 2 wherein the magnets present magnetic poles that face the same direction.

5. The tool of claim 2 further comprising a retaining block which retains the magnets within the housing.

6. The tool of claim 1 wherein:
the ribs each present two lateral sides; and
at least one of said at least one cavity is formed in each lateral side.

7. The tool of claim 1 further comprising a stabilizer that prevents axial movement of the retaining ring.

8. A magnetic retrieval tool comprising:
a tool body having a central shaft;
a plurality of ribs extending radially outwardly from the shaft and extending axially along the shaft, each of the ribs presenting at least one outer lateral side surface with at least one cavity formed therein;
a radially-reduced recess disposed angularly between each two adjoining ribs;
a magnetic member disposed within each cavity for attracting metallic debris, the magnetic member comprising:
a) a housing;
b) a magnet residing with the housing;
the magnet tube being retained within the cavity by a wedge member that resides within the recess; and
a retaining ring that surrounds the tool body and secures the wedge member within the recess.

9. The tool of claim 8 wherein a plurality of magnets reside within the housing.

10. The tool of claim 9 wherein a spacer is disposed between adjacent magnets.

11. The tool of claim 9 further comprising a retaining block that is secured to the housing to retain the magnets within the housing.

12. The tool of claim 9 wherein the magnets present magnetic poles that face the same direction.

13. The tool of claim 8 wherein:
the ribs each present two lateral sides; and
at least one of said at least one cavity is formed in each lateral side.

14. The tool of claim 8 further comprising a stabilizer that prevents axial movement of the retaining ring.

15. A method for retaining magnets upon a tool body of a magnetic retrieval tool, the method comprising the steps of:
providing a tool body having a central shaft, a plurality of ribs extending radially outwardly from the shaft and axially along the shaft, each of the ribs presenting at least one outer lateral side surface with a cavity formed therein, and a radially-reduced recess disposed angularly between each two adjoining ribs;
disposing a magnetic member within each cavity; and
disposing a wedge member within each recess to retain the magnetic members within the cavities; and
surrounding the tool body and the wedge members with a retaining ring to secure the wedge members within the recesses.

16. The method of claim 15 further comprising the step of providing the magnetic member in the form of a housing and a plurality of magnets retained within the housing.

* * * * *